US007899609B2

(12) United States Patent
Rodrigues et al.

(10) Patent No.: US 7,899,609 B2
(45) Date of Patent: Mar. 1, 2011

(54) METHOD FOR CONTROLLING THE POWER SUPPLY OF A PRE-HEAT PLUG IN AN INTERNAL COMBUSTION ENGINE

(75) Inventors: Juan Miguel Rodrigues, Paris (FR); Nicolas Palanque, Vincennes (FR)

(73) Assignee: Renault S.A.S., Boulogne-Billancourt (FR)

( * ) Notice: Subject to any disclaimer, the term of this patent is extended or adjusted under 35 U.S.C. 154(b) by 0 days.

(21) Appl. No.: 12/520,637

(22) PCT Filed: Dec. 21, 2007

(86) PCT No.: PCT/EP2007/064472

§ 371 (c)(1),
(2), (4) Date: Sep. 21, 2009

(87) PCT Pub. No.: WO2008/077947

PCT Pub. Date: Jul. 3, 2008

(65) Prior Publication Data

US 2010/0063705 A1 Mar. 11, 2010

(30) Foreign Application Priority Data

Dec. 22, 2006 (FR) ..... 06 11286

(51) Int. Cl.
*F23Q 7/00* (2006.01)
*F02P 19/00* (2006.01)

(52) U.S. Cl. ..... 701/112; 701/113; 123/406.55; 123/145 A; 123/179.6

(58) Field of Classification Search ..... 123/406.55, 123/145 A, 145 R, 179.6; 701/112, 113
See application file for complete search history.

(56) References Cited

U.S. PATENT DOCUMENTS 4,896,636 A * 1/1990 Pfefferle ..... 123/145 A
5,146,881 A * 9/1992 Pfefferle ..... 123/145 A

FOREIGN PATENT DOCUMENTS

| | | |
|---|---|---|
| DE | 103 48 391 B3 | 12/2004 |
| EP | 0 492 084 A2 | 7/1992 |
| GB | 2 159 578 A | 12/1985 |
| JP | 59-41673 | 3/1984 |

OTHER PUBLICATIONS

Hans Houben, et al., "Das elecktronisch gesteuerte Glühsystem ISS für Dieselmotoren", MTZ Motortechnische Zeitschrift, vol. 61, No. 10, XP-000965961, Oct. 2000, pp. 668-676.

* cited by examiner

*Primary Examiner*—Hai H Huynh
(74) *Attorney, Agent, or Firm*—Oblon, Spivak, McClelland, Maier & Neustadt, L.L.P.

(57) ABSTRACT

A method for controlling power supply of a pre-heat plug in an internal combustion engine to reach an ignition temperature for restarting the engine after the engine has stopped. The temperature of the pre-heat plug is determined using a first mathematical model and according to an elapsed engine-stop time, and additional energy to be supplied to the pre-heat plug for reaching the ignition temperature is determined using a second mathematical model and according to the temperature of the pre-heat plug.

9 Claims, 4 Drawing Sheets

$T_{d_plug}$
$T_{ign}$
Time
Rapid pre-heating
Rapid pre-heating
Sustained heating
Phase of post-heating following engine start
Phase of pre-heating prior to engine start
Phase of heating during engine start
Engine started
Percentage DC
100%
Time

METHOD FOR CONTROLLING THE POWER SUPPLY OF A PRE-HEAT PLUG IN AN INTERNAL COMBUSTION ENGINE

TECHNICAL FIELD OF THE INVENTION

The present invention relates in general to the supply of power to pre-heater plugs.

It relates in particular to a method for controlling the supply of electrical power to a pre-heater plug of an internal combustion engine, in order to reach an ignition temperature so that the engine can be restarted after it has been stopped.

TECHNOLOGICAL BACKGROUND

In diesel engines, pre-heater plugs are used to ensure that a certain temperature, known as the ignition temperature, is reached in the combustion chamber so that the combustion reaction of the air/fuel mixture can take place spontaneously when the pressure of the mixture is increased.

In order to pre-heat the air/fuel mixture it is known practice to use high-voltage pre-heater plugs which are powered with a dc voltage from the electrical voltage provided by the battery.

What a high-voltage pre-heater plug means is a plug which is powered at a voltage equal to the battery voltage, and what a low-voltage pre-heater plug means is a plug which is powered at a voltage lower than the battery voltage.

Nowadays, it is preferable to use low-voltage pre-heater plugs which do not take as long as high-voltage pre-heater plugs to reach the ignition temperature. This is because, during a rapid pre-heating phase, the low-voltage plugs will be powered at an overvoltage (at 11 volts) causing the temperature of the plug to increase very rapidly.

However, the duration of the rapid pre-heating phase needs to be controlled in order to avoid overheating that could lead to damage to the plug.

Thus it is found that restarting the engine, just after the engine has been stopped, causes a significant overheating of the tip of the plug, damaging it. The solution is therefore to wait for the plug temperature to have dropped sufficiently.

It is also known practice to use a temperature sensor to determine the temperature of the pre-heater plug and thus regulate its supply of power as a function of the temperature value acquired by the sensor, so as not to overheat the plug. However, use of such a sensor represents a high cost.

OBJECT OF THE INVENTION

The present invention proposes a novel method for controlling the supply of power to pre-heater plugs which is inexpensive and allows the engine to be restarted rapidly while at the same time maintaining plug integrity.

To this end, the invention proposes a method for controlling the supply of electrical power to a pre-heater plug of an internal combustion engine, in order to reach an ignition temperature so that the engine can be restarted after it has been stopped, which includes the following steps:

a) the temperature of the pre-heater plug is determined using a first mathematical model and as a function of the time that has elapsed since the engine was stopped, b) the additional energy to be supplied to the pre-heater plug in order to reach the ignition temperature is determined using a second mathematical model and as a function of the temperature of the pre-heater plug.

By virtue of the method according to the invention, each plug, which still has a certain temperature following the stopping of the engine, can be supplied with power in such a way as to receive the additional energy it needs to bring it up to a high enough temperature for the engine to be restarted. This additional energy is thus less than the energy delivered to a cold plug, that is to say a plug of minimal temperature, thus limiting the risk of damaging the plug. Rapid engine restart is thus permitted without damage to the plug.

The method according to the invention thus makes it possible to avoid having to wait for a certain period of time before being able to restart. Nor is it any longer necessary to use devices for measuring the temperature of the pre-heater plug.

Further, such a restart method makes it possible to obtain engine restart under good thermodynamic conditions, causing good combustion of the air/fuel mixture. Pollutant emissions are thus limited.

According to a first advantageous feature of the method according to the invention, the first mathematical model is the characteristic law governing the increase in temperature of the pre-heater plug.

According to another advantageous feature of the method according to the invention, the second mathematical model is the characteristic law governing the drop in temperature of the pre-heater plug.

According to another advantageous feature of the method according to the invention, the additional energy is converted by an engine computer into an additional heating time.

According to another advantageous feature of the method according to the invention, the computer calculates, from the additional heating time, a correction factor that needs to be applied to a reference heating time.

According to another advantageous feature of the method according to the invention, the correction factor is also calculated as a function of the temperature of the combustion chamber of the engine.

According to another advantageous feature of the method according to the invention, the reference heating time is the heating time that needs to be applied to a pre-heater plug the temperature of which has, after the engine was stopped, reached its minimum value, in order for the pre-heater plug once again to reach the ignition temperature.

According to another advantageous feature of the method according to the invention, the pre-heater plug is a low-voltage pre-heater plug.

According to another advantageous feature of the method according to the invention, after step b), the determined amount of additional energy is delivered to the pre-heater plug in electric voltage pulses using the pulse width modulation method.

DETAILED DESCRIPTION OF ONE EMBODIMENT

The description which will follow, with reference to the attached drawings which are given by way of nonlimiting example, will make it easy to understand the substance of the invention and how it can be embodied.

Figure 1:
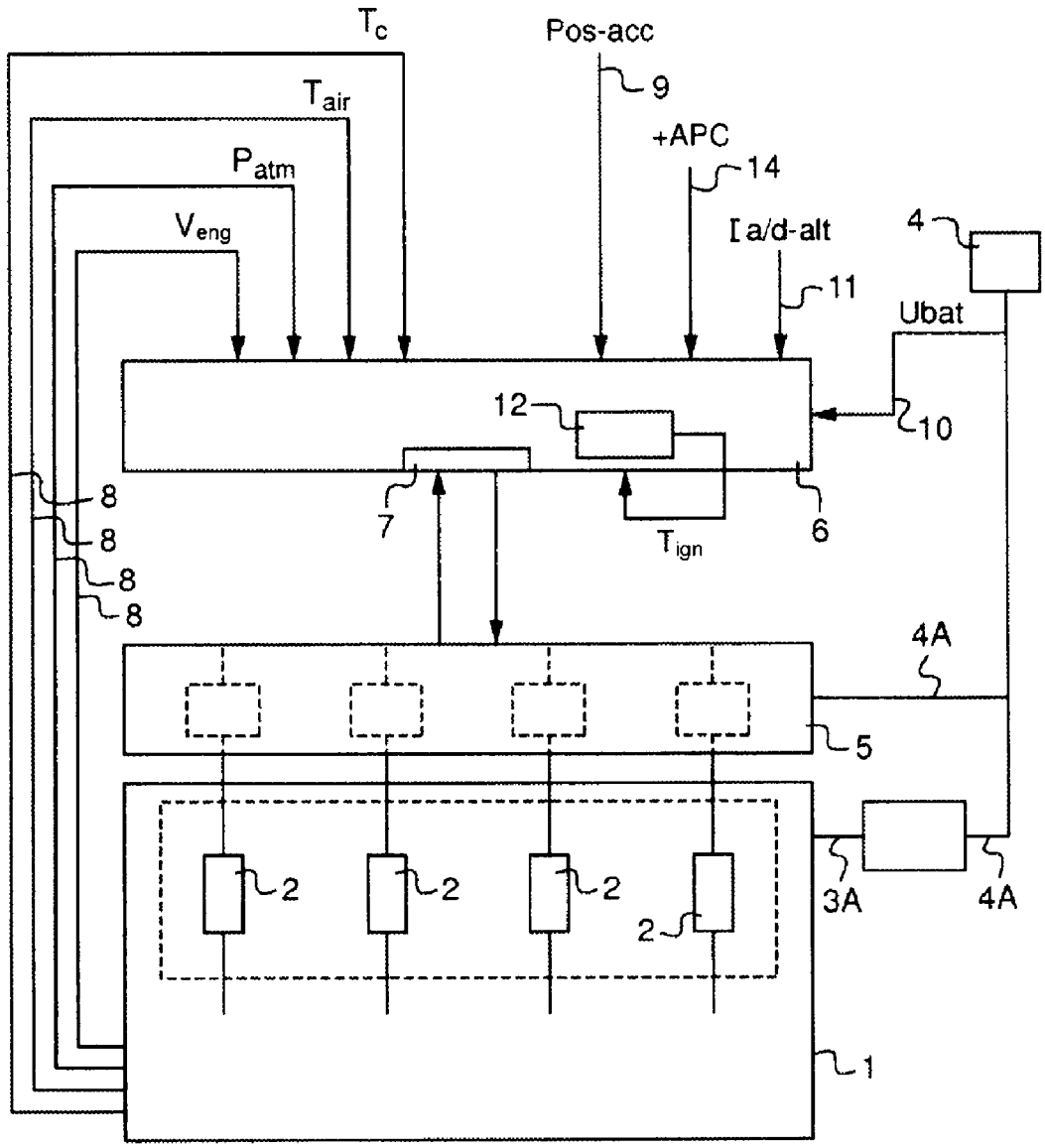
FIG. 1 is a diagram of the existing connections between an engine, the engine plug power supply means and a computer.

FIG. 1 depicts an internal combustion engine 1 of the diesel type for a motor vehicle. The engine 1 comprises four low-voltage pre-heater plugs 2. An alternator 3 is connected to the engine 1 via a connection 3*a*.

The plugs 2 are each powered by a plug 2 power control module 5.

There is also an electronic processing unit known as a computer 6. This computer 6 controls the various components of the engine as a function of the information it receives.

Sensors (not depicted) can be used to determine engine operating parameters such as the temperature of the coolant Tc, the temperature of the admitted air Tair, atmospheric pressure Patm, and the rotational speed of the engine Veng. These engine operating parameters are transmitted by a connection 8 to the control unit 6.

The computer 6 comprises means 7 of managing the plug 2 power control module 5. As an alternative, it is possible for the plug 2 power control module 5 to be incorporated into the computer.

The power control module 5 is controlled by the management module 7 of the computer 6 to deliver, to the plugs 2, a voltage according to the principle of pulse width modulation (PWM). The principle is as follows. For a voltage U and a fixed period T, the time for which the voltage U is applied over the period T is varied. It is then possible to define the duty cycle DC (see FIG. 4), ranging between 0 and 100%, as the percentage between the length of time for which the voltage U is applied during the period T, and the length of this period T.

The duty cycle DC applied for supplying power to the plug is determined by the management module 7 as a function, in particular, of the temperature of the coolant Tc, the temperature of the admitted air Tair, atmospheric pressure Patm, and the rotational speed of the engine Veng.

The principle of pulse width modulation means that the plug temperature can be increased while at the same time regulating this temperature, in order to avoid damage to the plugs.

An electric battery 4 is able to power the computer, the plug 2 power control module 5 and the alternator 3 at the electric voltage Ubat.

The computer 6 also receives other information such as a parameter Pos_acc, representing the position of the accelerator pedal, via a connection 9, the electrical voltage available Ubat provided by the electric battery 4 via a connection 10, and a parameter Ia/d_alt representative of whether the engine alternator 3 is activated or deactivated, via a connection 11.

Further, the computer receives at input a temperature Tign that the plugs are to provide, that is to say the ignition temperature. This ignition temperature Tign of the plugs 2 can be determined using a map 12 from parameters transmitted to the computer.

The computer receives, at input via a connection 14, a parameter +APC that represents whether the contact between the electric battery 4 and the electrical components of the engine is closed (+APC=1) or open (+APC=0).

Figure 3A:
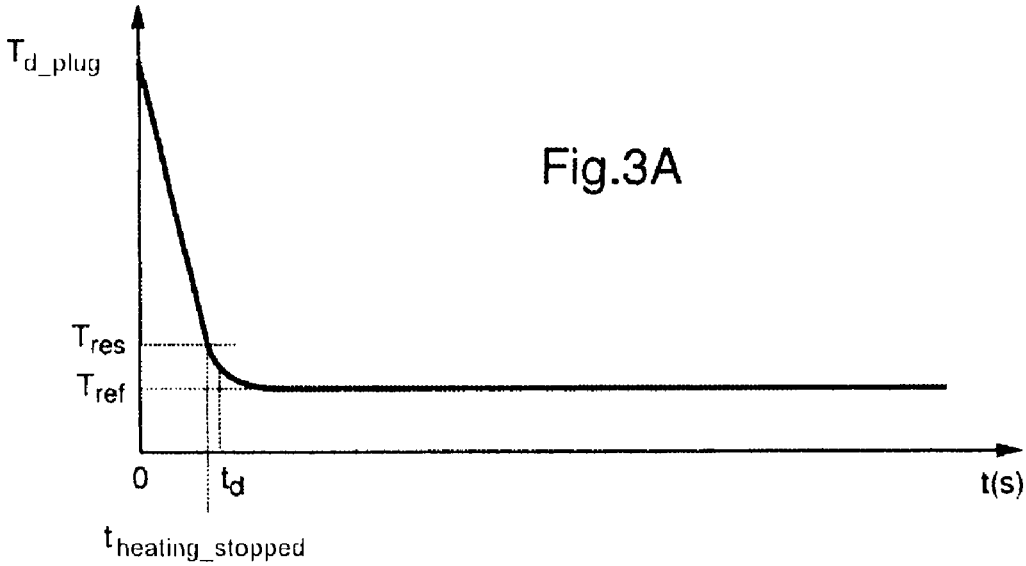
FIG. 3A is a graph representing the characteristic law governing the drop in temperature of a plug.
Figure 3B:
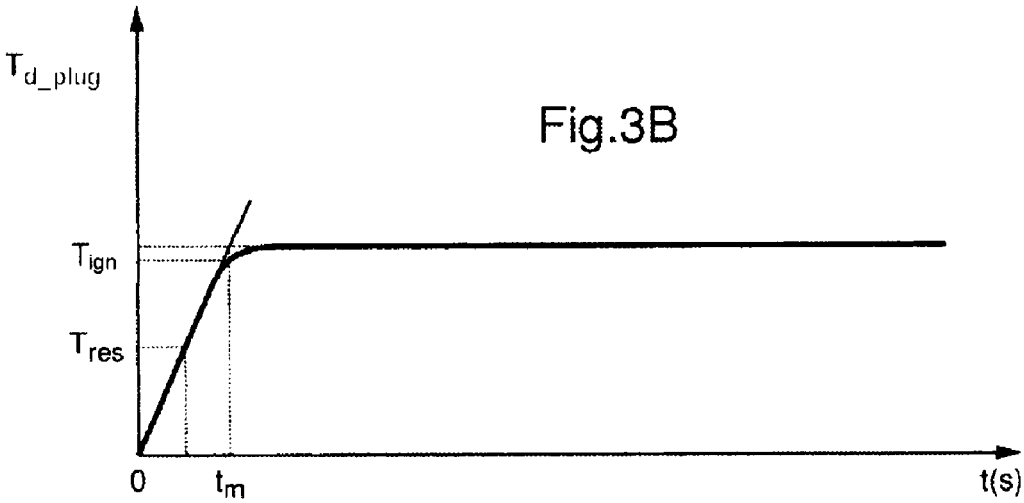
FIG. 3B is a graph representing the characteristic law governing the increase in temperature of a plug.

Advantageously, according to the invention, the characteristic laws governing the thermal behavior of each plug, as represented in FIGS. 3A and 3B, are known and stored in the computer 6.

The characteristic laws governing the thermal behavior of each plug include a characteristic law governing the drop in temperature of the plug (FIG. 3A) and a characteristic law governing the increase in temperature of the plug (FIG. 3B):

The equation for the characteristic law governing the increase in temperature of the plug can be written:

$$Ti\text{plug}(t)=Ki+h\cdot(1-\exp(-t/ti)),$$

where t is the time, Ki is the initial temperature of the plug, h is the increase in temperature, ti is the response time of the plug as it increases in temperature.

The equation for the characteristic law governing the drop in temperature of the plug can be written:

$$Td\text{plug}(t)=Kd\cdot(\exp(-t/td)),$$

where t is the time, Kd is the initial temperature of the plug, h is the increase in temperature, and td is the response time of the plug as it drops in temperature.

The parameters t, Ki, Kd, h, ti, td are provided by the manufacturer of the plugs or obtained during experimental testing.

Thanks to the plug drop in temperature curve, the computer has, stored within it, the value of the cooling temperature of each plug. The cooling temperature of a plug is defined as being the temperature of the plug when it is no longer powered for a time approaching infinity. It is considered that this cooling temperature is reached at the time td.

Further, the computer contains in its memory a map that can be used to determine the temperature Tcomb within the combustion chamber at each moment, as a function of the engine speed and torque which are represented respectively by the parameters Veng and Pos_acc. This map of the combustion chamber temperature, which also corresponds to the temperature in the region surrounding the plug, can be obtained during engine validation testing, for example.

Using the temperature in the combustion chamber and the laws of convection and of conduction, and as a function of the time during which the heating of the plugs is stopped, the computer can determine the plug temperature at every moment.

Figure 2:
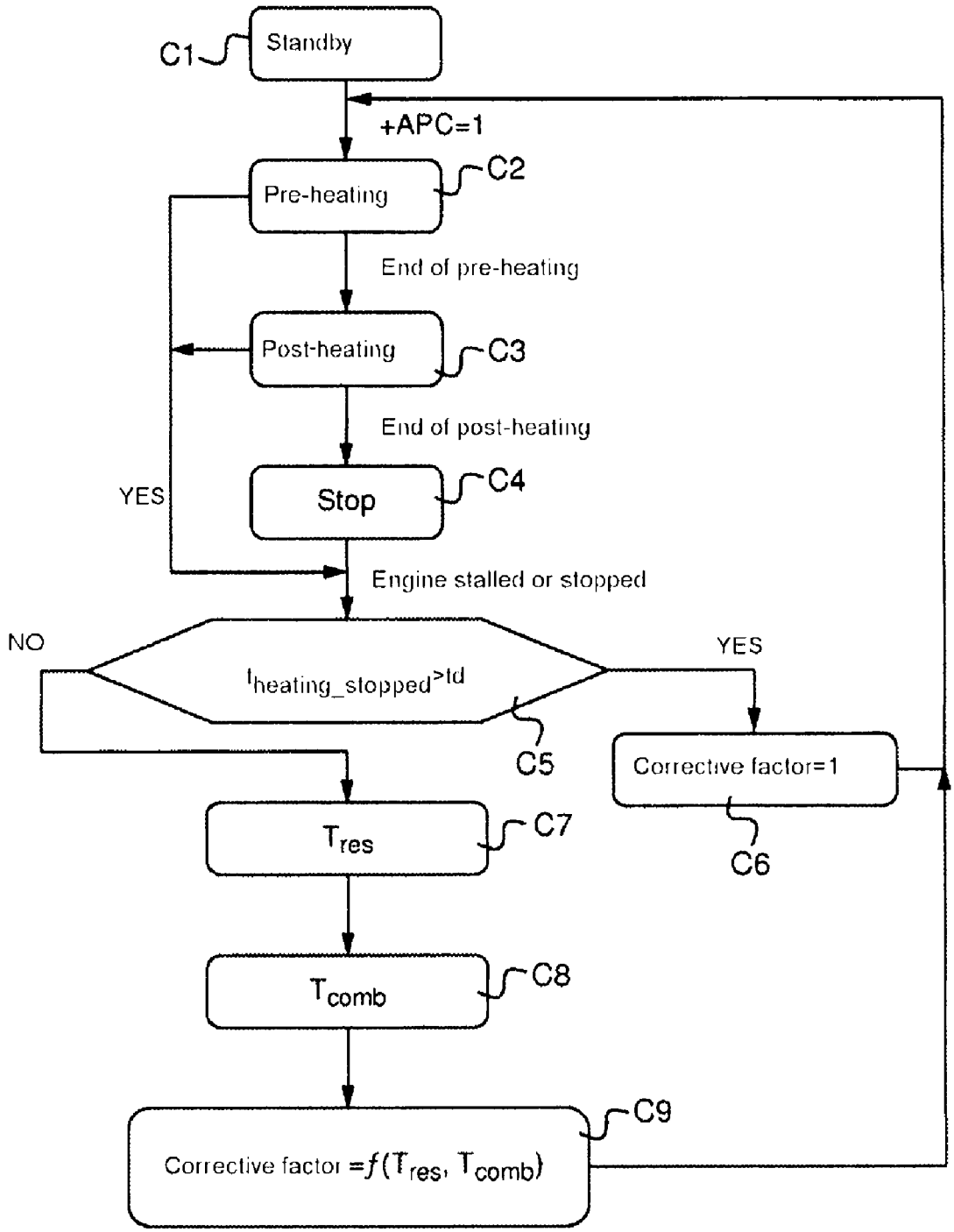
FIG. 2 is a flow diagram showing the various steps in the method of supplying power according to the invention.

The method of controlling the supply of power to the pre-heater plug involves several steps which are set out on the flow diagram of FIG. 2.

Figure 4:
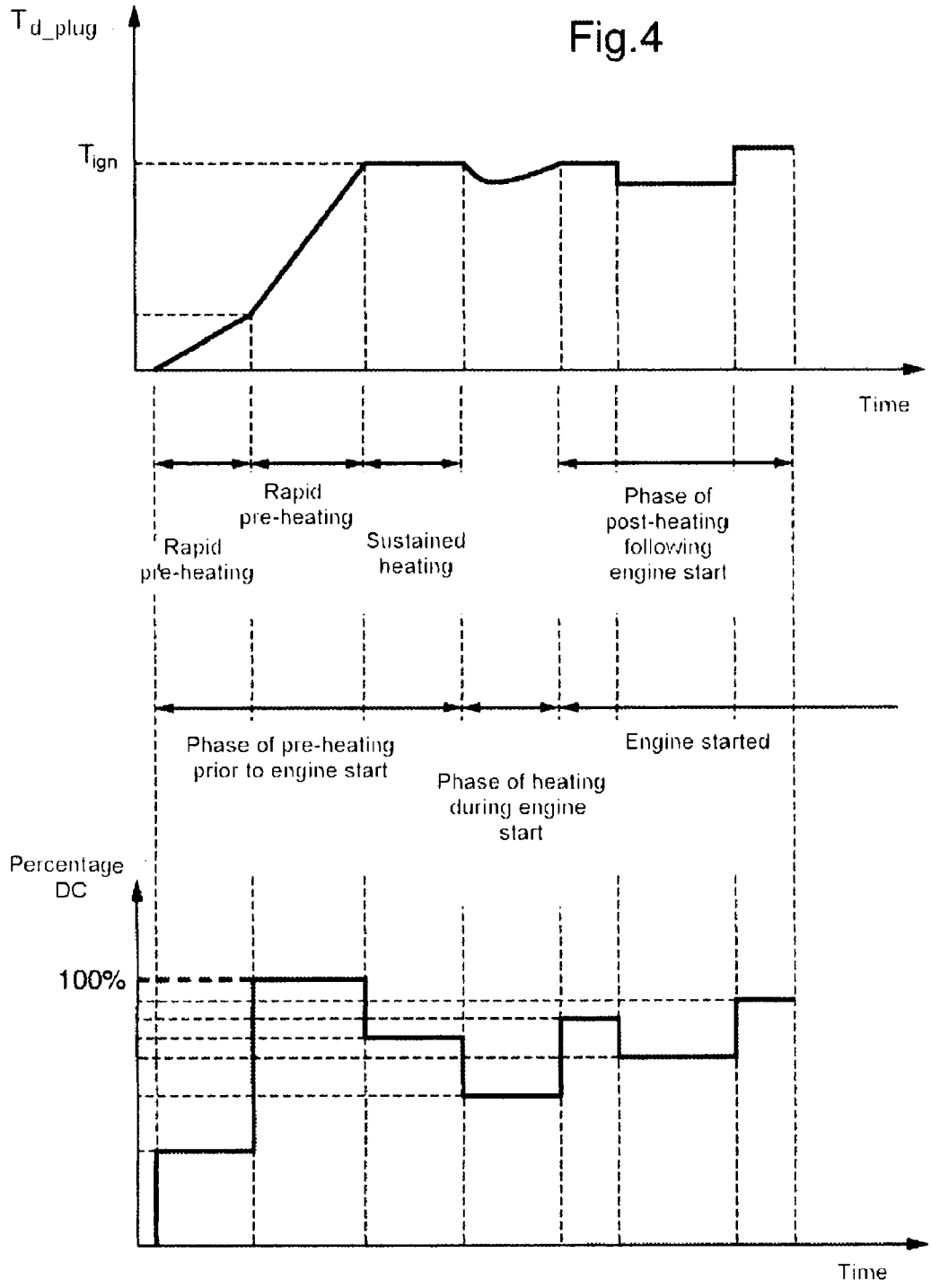
FIG. 4 is a graph giving the temperature of a plug as a function of the phases of heating of this plug.

The phases of pre-heating and post-heating are controlled by the management module 7 which, via the plug power control module 5, varies the duty cycle DC percentage applied and the corresponding lengths of application, as illustrated in the graphs of FIG. 4.

As depicted in the flow diagram of FIG. 2, the vehicle is initially on standby (box C1). That means that the computer, the plug management module 7 and the alternator 3 are ready to execute or receive instructions.

When the computer, through the parameter +APC adopting the value 1, detects that the contact between the electric battery 4 and the electrical components of the engine is closed, it begins a phase of pre-heating the plugs (box C2).

As depicted in FIG. 4, the pre-heating phase comprises a first phase of rapid pre-heating followed by a second phase of pre-heating that is more rapid still, and finally a phase in which the heating is sustained.

When the pre-heating phase is over, a pre-heating indicator lamp goes out and the driver turns the ignition key to start the engine. The pre-heating phase is then followed by a specific heating phase that is performed during engine start.

A phase of post-heating (box C3) is carried out after the engine has started. When the engine has reached a cruising speed, the heating of the plugs is stopped (box C4). A top-up heating phase may be performed as the engine torque increases.

During the phases of pre-heating and post-heating, starting or alternatively after a post-heating phase, the engine may stall or stop unexpectedly.

The remainder of the description deals with the case of an unexpected stopping of the engine during the pre-heating step, which is considered by way of an example of an implementation of the method according to the invention. Of course, the method as described hereinabove can be applied to any kind of engine stoppage, whatever its operating status. More generally, the method described hereinbelow is applied to the case where the engine has stopped and the driver wishes to restart the engine soon after.

When the computer detects that the engine has unexpectedly stopped, it executes the steps detailed hereinbelow. In the remainder of the description, the control method is described in respect of one plug, but it of course applies likewise to the other plugs.

The computer determines the length of time for which the plug has stopped heating after the engine was stopped, which amounts to calculating the time that has elapsed since the moment the engine stopped unexpectedly. As illustrated by box 5, it then compares this time for which heating of the plug is stopped, theating_stopped, against the plug cooling time, considered to be the response time of the plug as its temperature drops td.

If the heating stopped time theating_stopped is greater than the response time for a drop in temperature td, then the plug has what is known as a residual temperature higher than its cooling temperature and the method of supplying power according to the invention adapts the plug heating phases in order not to damage this plug, as explained hereinbelow.

According to a step illustrated in box C7, the computer determines what is known as the residual temperature of the plug Tres from the characteristic law governing the drop in temperature of the plug and as a function of the time for which heating of the plug is stopped theating_stopped and of the temperature Thot which is known for the plug at the moment the engine stopped:

$$Tres=Thot\cdot(\exp(-t/theating_stopped)).$$

From the residual plug temperature Tres determined and from the characteristic law governing the increase in temperature of the plug, the computer 6 determines the additional energy Eadd to be supplied to the plug in order for this plug to reach the ignition temperature Tign needed for the engine to restart. The computer 2 converts the additional energy Eadd determined into an additional heating time t_add, bearing in mind the power of the plug. This energy Eadd is determined for a maximum value of the duty cycle percentage (for example 15%) during the time t_add. This time t_add is given by the equation:

$$t_add=ti\cdot(Ln(Tign-Tres-h)-Ln(h)).$$

At the same time, the computer determines (box C8) the temperature Tcomb in the engine combustion chamber, as described hereinabove, using a map.

The computer then calculates a corrective time t_corr to be applied to the additional time t_add to take account of the temperature in the combustion chamber Tcomb. This corrective time t_corr is obtained from a map as a function of the temperature in the combustion chamber Tcomb.

The rapid pre-heating time t_htrap to be applied to the plug in order to obtain a restart without plug damage is then:

$$t_htrap=t_add-t_corr.$$

Of course, if the combustion chamber temperature Tcomb is below the residual plug temperature Tres, this temperature Tcomb is not taken into consideration when calculating the corrective factor.

According to a step illustrated by box C9, the computer then calculates the correction factor to be applied to the heating time intended for ignition with a so-called cold plug t_igncold, that is to say a plug which has reached its cooling temperature, in order to obtain a heating time setpoint value for t_htrap: this correction factor is equal to the ratio t_htrap/t_igncold.

The computer 6 also determines whether the engine has stopped during a phase of pre-heating or a phase of post-heating. Here, as recalled hereinabove, the engine stopped during the pre-heating phase. The corrective factor t_corr is therefore applied to the pre-heating time.

As illustrated by box C6 in FIG. 2, if the determined time for which heating of the plug was stopped, theating_stopped, is greater than the cooling time td of the plug, then the heating time to be applied to the plug for normal engine starting is not modified. The corrective factor is then equal to 1.

The present invention is not in any way restricted to the embodiment described and depicted, and those skilled in the art will know how to vary it in any way that is in accordance with its spirit.

The invention claimed is:

1. A method for controlling supply of electrical power to a pre-heater plug of an internal combustion engine, to reach an ignition temperature so that the engine can be restarted after the engine has been stopped, the method comprising:

a) determining temperature of the pre-heater plug using a first mathematical model and as a function of time that has elapsed since the engine was stopped; and b) determining additional energy to be supplied to the pre-heater plug to reach the ignition temperature using a second mathematical model, as a function of the temperature of the pre-heater plug and of the temperature of the combustion chamber surrounding the pre-heater plug.

2. The method as claimed in claim 1, wherein the first mathematical model is a characteristic law governing drop in temperature of the pre-heater plug.

3. The method as claimed in claim 1, wherein the second mathematical model is a characteristic law governing increase in temperature of the pre-heater plug.

4. The method as claimed in claim 1, wherein the additional energy is converted by an engine computer into an additional heating time.

5. The method as claimed in claim 4, wherein the computer calculates, from the additional heating time, a correction factor that needs to be applied to a reference heating time.

6. The method as claimed in claim 5, wherein the correction factor is also calculated as a function of the temperature of the combustion chamber of the engine.

7. The method as claimed in claim 4, wherein the reference heating time is the heating time that needs to be applied to a pre-heater plug, the temperature of which has, after the engine was stopped, reached its minimum value, for the pre-heater plug once again to reach the ignition temperature.

8. The method as claimed in claim 1, wherein the pre-heater plug is a low-voltage pre-heater plug.

9. The method as claimed in claim 1, wherein, after the determining b), the determined amount of additional energy is delivered to the pre-heater plug in electric voltage pulses using a pulse width modulation.

* * * * *